US010203643B2

(12) United States Patent
Yoshida

(10) Patent No.: US 10,203,643 B2
(45) Date of Patent: Feb. 12, 2019

(54) IMAGE FORMING APPARATUS WHICH PREDICTS A DEGREE OF CONSUMPTION OF A PHOTOSENSITIVE BODY

(71) Applicant: KONICA MINOLTA, INC., Chiyoda-ku, Tokyo (JP)

(72) Inventor: Tomohisa Yoshida, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/812,020

(22) Filed: Nov. 14, 2017

(65) Prior Publication Data

US 2018/0173147 A1 Jun. 21, 2018

(30) Foreign Application Priority Data

Dec. 15, 2016 (JP) ..... 2016-243671

(51) Int. Cl.

*G03G 15/00* (2006.01)
*G03G 21/00* (2006.01)
*G03G 21/16* (2006.01)

(52) U.S. Cl.

CPC ..... *G03G 15/553* (2013.01); *G03G 15/5033* (2013.01); *G03G 15/55* (2013.01); *G03G 21/1671* (2013.01)

(58) Field of Classification Search

CPC ..... G03G 15/5033; G03G 15/5037; G03G 15/553; G03G 15/751; G03G 21/1671; G03G 15/55

See application file for complete search history.

(56) References Cited

U.S. PATENT DOCUMENTS

2010/0303480 A1* 12/2010 Stuckey ..... G03G 15/553 399/26
2014/0016953 A1* 1/2014 Yoshida ..... G03G 15/5033 399/26

FOREIGN PATENT DOCUMENTS

JP 2005283736 A 10/2005
JP 2010217532 A 9/2010

* cited by examiner

*Primary Examiner* — Sophia S Chen
(74) *Attorney, Agent, or Firm* — Holtz, Holtz & Volek PC

(57) ABSTRACT

An image forming apparatus includes an image forming device that forms an image by an electrophotographic method, wherein the image forming device includes the photosensitive body on which two or more layers are laminated, and further includes a hardware processor that predicts a degree of consumption of a photosensitive body, and the hardware processor specifies timing when a layer begins to lie on an outermost side, the layer being one of the two or more layers and lying on the outermost side at time of predicting the degree of consumption, and uses an electrical characteristic of the image forming device after the timing specified, to predict the degree of consumption of the photosensitive body.

10 Claims, 9 Drawing Sheets

FIG. 8

● SITUATION 1 (FIRST LAYER LIES ON OUTERMOST SIDE)

(1) PREDICTION VALUE OF NUMBER OF ROTATIONS AT WHICH FIRST LAYER DISAPPEARS (NUMBER OF ROTATIONS N1) → PREDICT FROM LINE L11

(2) NUMBER OF ROTATIONS NX AT WHICH REPLACEMENT IS REQUIRED = NUMBER OF ROTATIONS N1 + SET VALUE NP (3) DEGREE OF CONSUMPTION OF PHOTOSENSITIVE BODY = (CURRENT NUMBER OF ROTATIONS NA/NUMBER OF ROTATIONS NX) × 100%

● SITUATION 2 (SECOND LAYER LIES ON OUTERMOST SIDE)

(1) NUMBER OF ROTATIONS AT WHICH REPLACEMENT IS REQUIRED (NUMBER OF ROTATIONS NX) → PREDICT FROM LINE L12

(2) DEGREE OF CONSUMPTION OF PHOTOSENSITIVE BODY = (CURRENT NUMBER OF ROTATIONS NA/NUMBER OF ROTATIONS NX) × 100%

IMAGE FORMING APPARATUS WHICH PREDICTS A DEGREE OF CONSUMPTION OF A PHOTOSENSITIVE BODY

The entire disclosure of Japanese patent Application No. 2016-243671, filed on Dec. 15, 2016, is incorporated herein by reference in its entirety.

BACKGROUND

Technological Field

The present disclosure relates to an image forming apparatus, and in particular relates to an image forming apparatus including a photosensitive body including two or more layers.

Description of the Related Art

Conventionally, in an image forming apparatus including a photosensitive body, a degree of consumption of the photosensitive body is specified, and replacement timing of the photosensitive body is specified on the basis of the degree of consumption specified. For example, JP 2005-283736 A discloses a technique for predicting a decrease in film thickness of the photosensitive body from the number of rotations and charging current of the photosensitive body. JP 2010-217532 A discloses a technique for detecting film thickness unevenness in the circumferential direction of the photosensitive body and specifying arrival of a lifetime of the photosensitive body when the unevenness exceeds a predefined unevenness.

However, in the conventional image forming apparatus, the photosensitive body includes multiple layers, and there has been a case where the multiple layers include respective different materials. When the materials included are different from each other, characteristics such as electrical characteristics may be different from each other. From this, in a case where the decrease in film thickness and the film thickness unevenness are specified with a uniform method and the degree of consumption of the photosensitive body is specified, there has been a case where an actual photosensitive body state cannot be correctly specified.

SUMMARY

The present disclosure has been devised in view of such circumstances, and an object of the present disclosure is to correctly specify the degree of consumption of the photosensitive body in the image forming apparatus.

To achieve the abovementioned object, according to an aspect of the present invention, an image forming apparatus reflecting one aspect of the present invention comprises an image forming device that forms an image by an electrophotographic method, wherein the image forming device includes the photosensitive body on which two or more layers are laminated, and further includes a hardware processor that predicts a degree of consumption of a photosensitive body, and the hardware processor specifies timing when a layer begins to lie on an outermost side, the layer being one of the two or more layers and lying on the outermost side at time of predicting the degree of consumption, and uses an electrical characteristic of the image forming device after the timing specified, to predict the degree of consumption of the photosensitive body.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 8 is a diagram showing a method for calculating the degree of consumption of the photosensitive body;

DETAILED DESCRIPTION OF EMBODIMENTS

Figure 1:
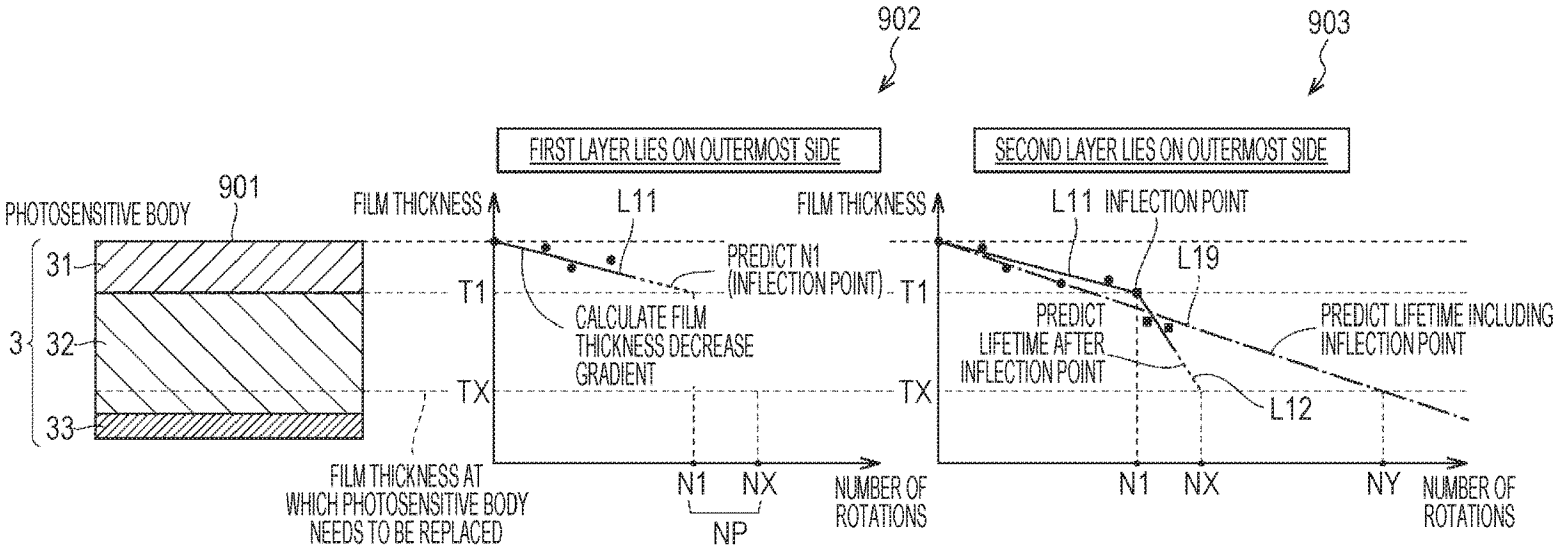
FIG. 1 is a diagram for explaining an overview of the present disclosure.

Hereinafter, one or more embodiments of an image forming apparatus according to the present invention will be described with reference to the drawings. However, the scope of the invention is not limited to the disclosed embodiments. In the following description, the same components and constituents are denoted by the same reference numerals. The names and functions thereof are also the same. Therefore, the description of those is not repeated.

[Summary of Disclosure]

FIG. 1 is a diagram for explaining an overview of the present disclosure. FIG. 1 includes a line drawing 901, a graph 902, and a graph 903. The line drawing 901 represents a part of the surface enlarged of a photosensitive body at the start of use in the image forming apparatus of the present disclosure. The photosensitive body includes multiple layers. In the line drawing 901, a first layer 31 lies on the outermost side when the photosensitive body is started to be used in the image forming apparatus, and is, for example, a so-called "coat layer". A second layer 32 lies on the second outermost side next to the first layer 31, and is, for example, a so-called "charge transport layer". A third layer 33 lies on the second outermost side next to the second layer 32, and is, for example, a so-called "charge generation layer".

The graph 902 and the graph 903 each represent a relationship between the film thickness and the number of rotations of the photosensitive body. The film thickness is, for example, a distance from a predetermined location inside the photosensitive body to the surface. The graph 902 corresponds to a state in which the first layer 31 lies on the outermost side in the photosensitive body. The graph 903 corresponds to a state in which the second layer 32 lies on the outermost side in the photosensitive body.

The photosensitive body has, for example, a roller shape. "The number of rotations" means, for example, an integrated value of the number of times that the photosensitive body being a roller is rotated. According as the photosensitive body is used for image formation, the number of rotations of the photosensitive body increases.

According as the photosensitive body is used for the image formation, the surface of the photosensitive body is worn out. Therefore, according as the photosensitive body is used for the image formation, the film thickness of the photosensitive body decreases.

The graph 902 indicates a relationship in a period from the start of use of the photosensitive body to before disappearance of the first layer 31. Each plot in the graph 902 represents an actual measurement value. For example, the film thickness is specified by using a relationship between the film thickness of the photosensitive body and a charging current value (a current value supplied to a charging roller) predetermined and stored in the image forming apparatus, and by measuring the charging current value.

In the period indicated in the graph 902, a relationship between the film thickness and the number of rotations can be approximated by a line L11. The line L11 represents, for example, a linear approximation obtained from multiple plots in a period up to disappearance of the first layer 31.

The graph 903, in addition to the period indicated in the graph 902, indicates a relationship between the film thickness and the number of rotations corresponding to a period corresponding to a state in which the first layer 31 disappears and the second layer 32 is exposed. Each plot in the graph 903 represents an actual measurement value. The graph 903 includes a part approximated by the line L11, and a part approximated by a line L12. The line L12 represents, for example, a linear approximation obtained from multiple plots after the second layer 32 is exposed. An inflection point between the line L11 and the line L12 corresponds to a boundary between the first layer 31 and the second layer 32.

The first layer 31 and the second layer 32 are made of different materials, respectively. In an example, the first layer 31 is made of a material with a higher hardness than that of the second layer 32. Thus, a degree of decrease in film thickness with respect to increase in the number of rotations is lower in a period during which the first layer 31 is the outermost surface (a period corresponding to the line L11) than in a period during which the second layer 32 is the outermost surface (a period corresponding to the line L12). That is, the amount of decrease in film thickness in a period during which the photosensitive body is rotated by the same number of rotations, is less in the period corresponding to the line L11 than in the period corresponding to the line L12.

The image forming apparatus according to the present disclosure, in a case of predicting the degree of consumption of the photosensitive body at a certain time, uses data after the start time of a layer lying on the outermost side.

For example, for prediction of the degree of consumption of the photosensitive body in a period during which the first layer 31 lies on the outermost side, as indicated by the graph 902, all data after the start of use of the photosensitive body can be used. The image forming apparatus generates the line L11, and specifies the number of rotations N1 (corresponding to a film thickness T1) from the line L11, as timing when the first layer 31 disappears, and further uses a predetermined number of rotations (the number of rotations NP in FIG. 1) from the disappearance of the first layer 31 to replacement of the photosensitive body, to calculate a prediction value of the number of rotations at which the replacement is required (the number of rotations NX). Then, the image forming apparatus defines a ratio of a current number of rotations to the number of rotations NX, as a prediction value of the degree of consumption of the photosensitive body.

For example, for prediction of the degree of consumption of the photosensitive body in a period during which the second layer 32 lies on the outermost side, as indicated by the graph 903, plots are used acquired after the time when the second layer 32 is exposed ("inflection point" in the figure). The image forming apparatus selects plots corresponding to a range in which film thickness is the film thickness T1 or less, from the plots indicated in the graph 903. The image forming apparatus uses the selected plots to generate a line L12, and specifies the number of rotations NX at which the line L12 corresponds to a film thickness TX, as timing when the replacement of the photosensitive body is required. Then, the image forming apparatus defines the ratio of the current number of rotations to the number of rotations NX as the prediction value of the degree of consumption of the photosensitive body.

In the graph 903, a line L19 is indicated as a comparative example. The line L19 is an example of a line of a linear approximation when the plots indicated in the graph 903 are all used without being selected. The number of rotations corresponding to the film thickness TX in the line L19 is indicated as the number of rotations NY. The number of rotations NY is a much larger value than the number of rotations NX.

As indicated as the line L19, in a case where the number of rotations corresponding to replacement timing of the photosensitive body is predicted by uniformly dealing with the relationship between the film thickness and the number of rotations without considering a difference between characteristics (hardness and the like) of layers of the photosensitive body, a value can be defined, as the prediction value, far from the number of rotations corresponding to an actual replacement timing (normally, the number of rotations NX in the graph 903). The image forming apparatus of the present disclosure uses only the actual measurement value corresponding to the layer lying on the outermost side at that time in the photosensitive body, as indicated as the line L12, to predict replacement timing of the photosensitive body, and predicts the degree of consumption of the photosensitive body on the basis of the timing thus predicted. Thus, the degree of consumption of the photosensitive body can be predicted in an aspect along an actual situation of the photosensitive body.

[Configuration Example of Image Forming Apparatus]

(Schematic Configuration)

Figure 2:
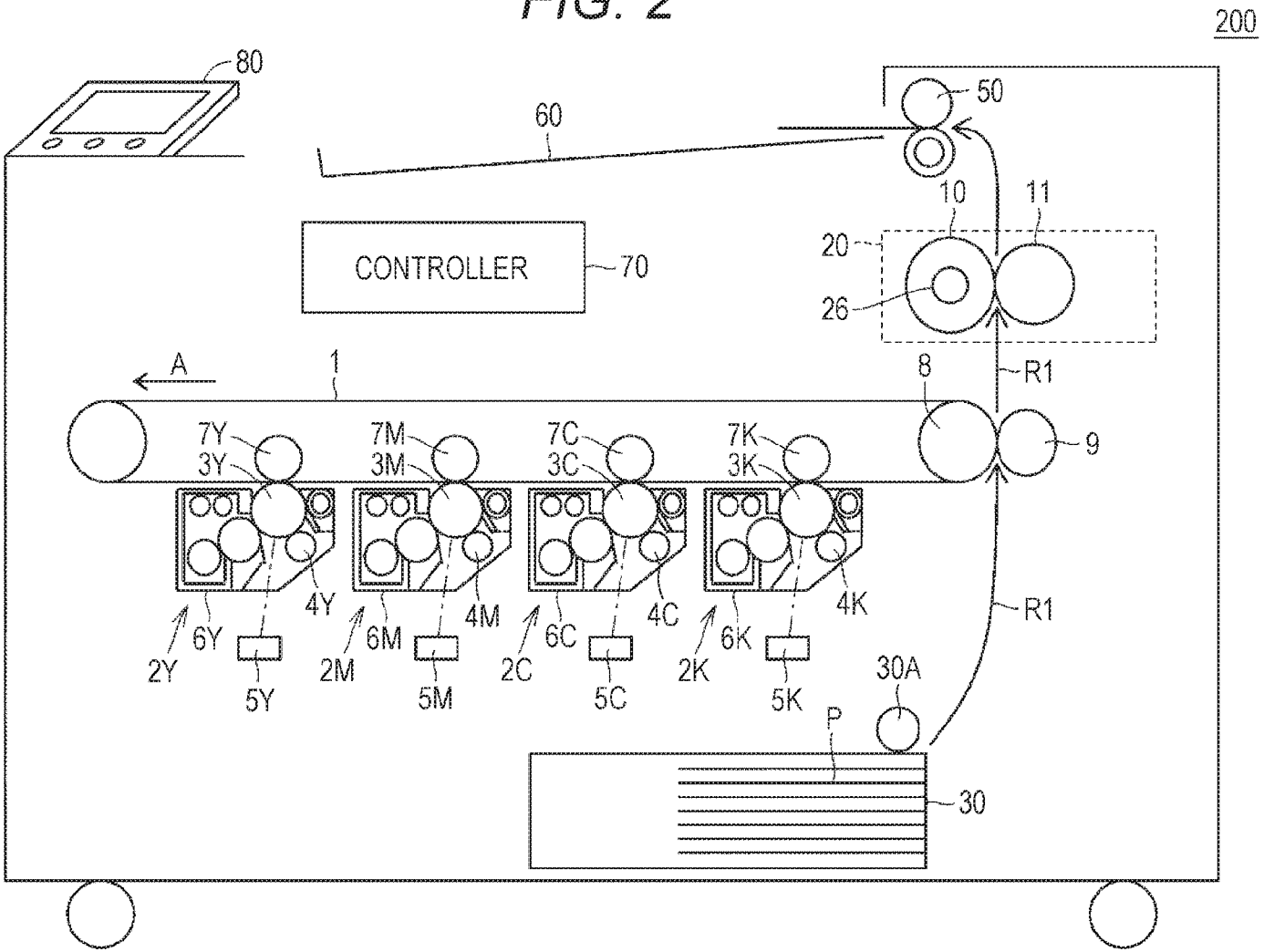
FIG. 2 is a diagram describing a configuration example of an image forming apparatus according to an embodiment.

FIG. 2 is a diagram describing a configuration example of an image forming apparatus 200 according to an embodiment. In the embodiment, the image forming apparatus 200 is an electrophotographic image forming apparatus such as a laser printer or a light emitting diode (LED) printer. The image forming apparatus 200 includes a control box (not illustrated) for accommodating an element including a control circuit (a controller 70 described later) for controlling operation of the image forming apparatus 200.

The image forming apparatus 200 includes an intermediate transfer roller 1 as a belt member in an approximately central part inside thereof. Below the lower horizontal part of the intermediate transfer roller 1, four imaging units 2Y, 2M, 2C, and 2K respectively corresponding to colors of yellow (Y), magenta (M), cyan (C), and black (K) are arranged side by side along the intermediate transfer roller 1. The imaging units 2Y, 2M, 2C, and 2K respectively include photosensitive bodies 3Y, 3M, 3C, and 3K each of which can carry a toner image.

Around the photosensitive bodies 3Y, 3M, 3C, and 3K being image carriers, in order along the rotation direction, charging rollers 4Y, 4M, 4C, and 4K for charging corresponding photosensitive bodies, print head parts 5Y, 5M, 5C, and 5K, developers 6Y, 6M, 6C, and 6K, and primary transfer rollers 7Y, 7M, 7C, and 7K respectively facing the photosensitive bodies 3Y, 3M, 3C, and 3K sandwiching the intermediate transfer roller 1, are respectively arranged.

In a part supported by an intermediate transfer belt drive roller 8 of the intermediate transfer roller 1, a secondary transfer roller 9 is in contact with to be pressed, and secondary transfer is performed in the area. An example of material of the secondary transfer roller 9 is, for example, conductive rubber. In a downstream location of a conveyance path R1 behind the secondary transfer area, a fixing and heating part 20 is arranged including a fixing roller 10 and a pressing roller 11. The fixing roller 10 includes a heater 26.

In the lower part of the image forming apparatus 200, a paper feed cassette 30 is detachably arranged.

Paper P stacked and stored in the paper feed cassette 30 is fed out to the conveyance path R1 one by one from the uppermost paper by rotation of a paper feed roller 30A. The paper P is an example of a recording medium.

In the upper part of the image forming apparatus 200, an operation panel 80 is arranged. The operation panel 80 includes, for example, a screen in which a touch screen and a display are superimposed on each other, and a physical button.

In a situation, the intermediate transfer roller 1, the charging rollers 4Y, 4M, 4C, and 4K, the primary transfer rollers 7Y, 7M, 7C, and 7K, and the secondary transfer roller 9 can function as conductive members with ionic conductivity. For example, these conductive members can include ion conductive rubber formulated by hydrin rubber, acrylonitrile butadiene rubber, epichlorohydrin rubber, and the like. Each of these conductive members can include appropriate ion conductive material depending on a required characteristic.

In the above example, the image forming apparatus 200 adopts a tandem type intermediate transfer method, but is not limited thereto. Specifically, it is sufficient that the image forming apparatus 200 is an image forming apparatus including a conductive member with ionic conductivity, and may be an image forming apparatus adopting a cycle method, and may be an image forming apparatus adopting a direct transfer method that directly transfers toner from a development device to a print medium.

(Schematic Operation)

Next, schematic operation will be described of the image forming apparatus 200. When an image signal is input from an external device (for example, a personal computer) to the controller 70 (provided in the control box, for example) of the image forming apparatus 200, the controller 70 creates a digital image signal in which the image signal is subjected to color conversion into yellow, cyan, magenta, and black, and, on the basis of the digital signal input, causes the print head parts 5Y, 5M, 5C, and 5K of the respective imaging units 2Y, 2M, 2C, and 2K to emit light to perform exposure.

Thus, electrostatic latent images formed on the photosensitive bodies 3Y, 3M, 3C, and 3K are respectively developed by the developers 6Y, 6M, 6C, and 6K to be toner images of the respective colors. The toner images of the respective colors are sequentially superimposed on the intermediate transfer roller 1 moving in the direction of an arrow A in FIG. 2, with function of the primary transfer rollers 7Y, 7M, 7C, and 7K, to be primarily transferred.

The toner images formed on the intermediate transfer roller 1 in this way are secondarily transferred collectively to the paper P, with function of the secondary transfer roller 9.

The toner images secondarily transferred to the paper P reach the fixing and heating part 20. The toner images are fixed to the paper P with functions of the fixing roller 10 heated, and the pressing roller 11. The paper P to which the toner images are fixed is ejected to an ejection tray 60 via an ejection roller 50.

(Configuration Near Photosensitive Body)

Figure 3:
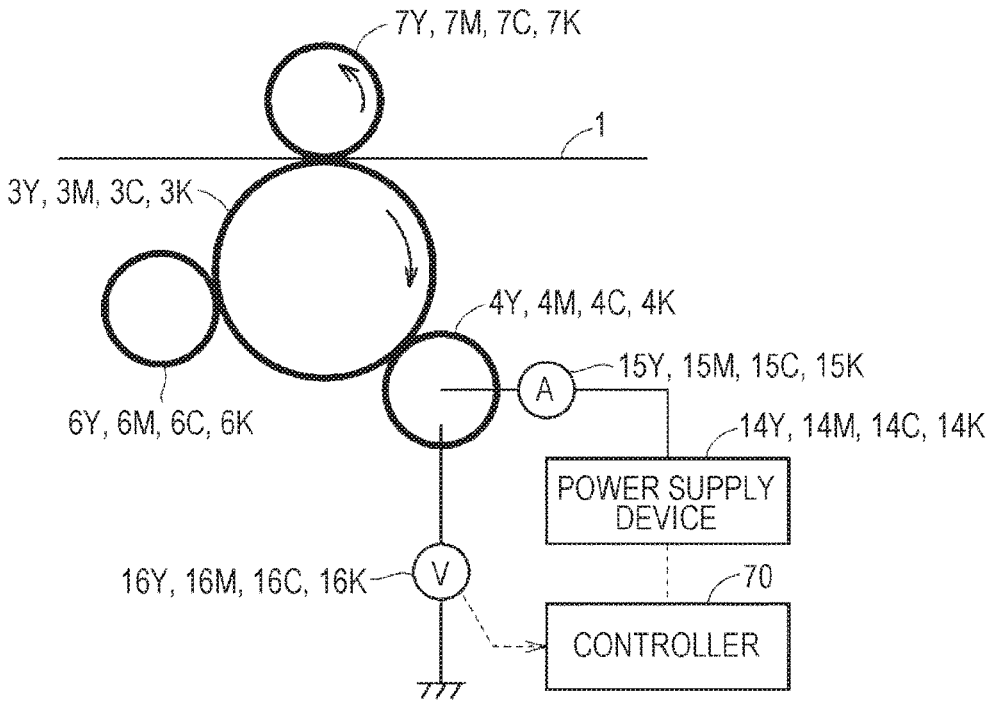
FIG. 3 is a diagram illustrating a configuration example near a photosensitive body in the image forming apparatus of FIG. 2.

FIG. 3 is a diagram illustrating a configuration example near the photosensitive bodies 3Y, 3M, 3C, and 3K in the image forming apparatus 200 of FIG. 2. In the image forming apparatus 200, in the imaging units 2Y, 2M, 2C, and 2K, the respective photosensitive bodies 3Y, 3M, 3C, and 3K, charging rollers 4Y, 4M, 4C, and 4K, print head parts 5Y, 5M, 5C, and 5K, developers 6Y, 6M, 6C, and 6K, and primary transfer rollers 7Y, 7M, 7C, and 7K may be arranged similarly. From this, in FIG. 3, a common arrangement in the imaging units 2Y, 2M, 2C, and 2K is illustrated. In the present specification, in a case of referring to a common characteristic in the photosensitive bodies 3Y, 3M, 3C, and 3K, the charging rollers 4Y, 4M, 4C, and 4K, the print head parts 5Y, 5M, 5C, and 5K, the developers 6Y, 6M, 6C, and 6K, and the primary transfer rollers 7Y, 7M, 7C, and 7K in the respective imaging units 2Y, 2M, 2C, and 2K, each of them may be referred to as a photosensitive body 3, a charging roller 4, a print head part 5, a developer 6, a primary transfer roller 7, and an imaging unit 2.

As illustrated in FIG. 3, the image forming apparatus 200 includes power supply devices 14Y, 14M, 14C, and 14K for respectively supplying power to the charging rollers 4Y, 4M, 4C, and 4K, and ammeters 15Y, 15M, 15C, and 15K and voltmeters 16Y, 16M, 16C, and 16K for respectively measuring current values and voltages of the power supplied. The controller 70 is electrically connected to each of the ammeters 15Y, 15M, 15C, and 15K, and the voltmeters 16Y, 16M, 16C, and 16K, thereby acquiring a corresponding measurement result.

In the present specification, in a case of referring to a common characteristic in the imaging units 2Y, 2M, 2C, and 2K, the ammeters 15Y, 15M, 15C, and 15K and the voltmeters 16Y, 16M, 16C, and 16K may respectively referred to as an ammeter 15 and a voltmeter 16.

(Partial Hardware Configuration)

Figure 4:
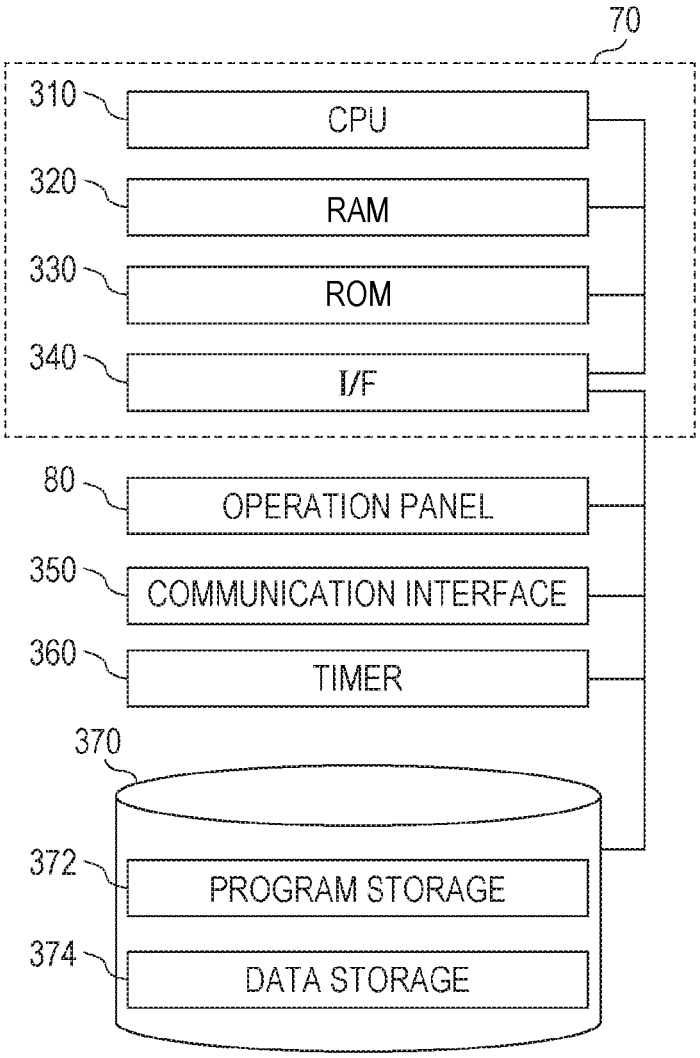
FIG. 4 is a diagram illustrating an example of a partial hardware configuration of the image forming apparatus of FIG. 2.

FIG. 4 is a diagram illustrating an example of a partial hardware configuration of the image forming apparatus 200 of FIG. 2. As illustrated in FIG. 4, the controller 70 includes, as its main control elements, a central processing unit (CPU) 310, random access memory (RAM) 320, read only memory (ROM) 330, and an interface (I/F) 340.

The CPU 310 operates as a computer of the image forming apparatus 200, and reads and executes a control program stored in the ROM 330 or a storage device 370 described later, to control operation of the image forming apparatus 200.

The RAM 320 typically is a dynamic random access memory (DRAM) or the like. The RAM 320 can temporarily store image data and data required for the CPU 310 to operate the program. The RAM 320 can function as a so-called working memory.

The ROM 330 typically is a flash memory or the like, and can store the program executed by the CPU 310 and various types of setting information according to operation of the image forming apparatus 200.

The CPU 310 is electrically connected to each of the operation panel 80, a communication interface 350, a timer 360, and the storage device 370 via the interface 340, and exchanges signals with various devices.

The communication interface 350 is, for example, a wireless local area network (LAN) card. The image forming apparatus 200 can communicate with external devices (such as a personal computer, a smart phone, and a tablet) connected to a LAN or a wide area network (WAN) via the communication interface 350.

The timer 360 counts time. For example, the timer 360 includes a crystal oscillator.

The storage device 370 typically includes a hard disk drive. The storage device 370 includes a program storage 372 and a data storage 374. The program storage 372 may store the program executed by the CPU 310. The data storage 374 may store the data used for processing in the present disclosure.

The image forming apparatus 200 includes an element (image forming device) driven in image forming operation. The controller 70 can be connected to the element, and can control operation of the element. The element includes, for example, various rollers configuring the imaging units 2Y, 2M, 2C, and 2K (FIG. 2).

[Flow of Processing]

Figure 5:
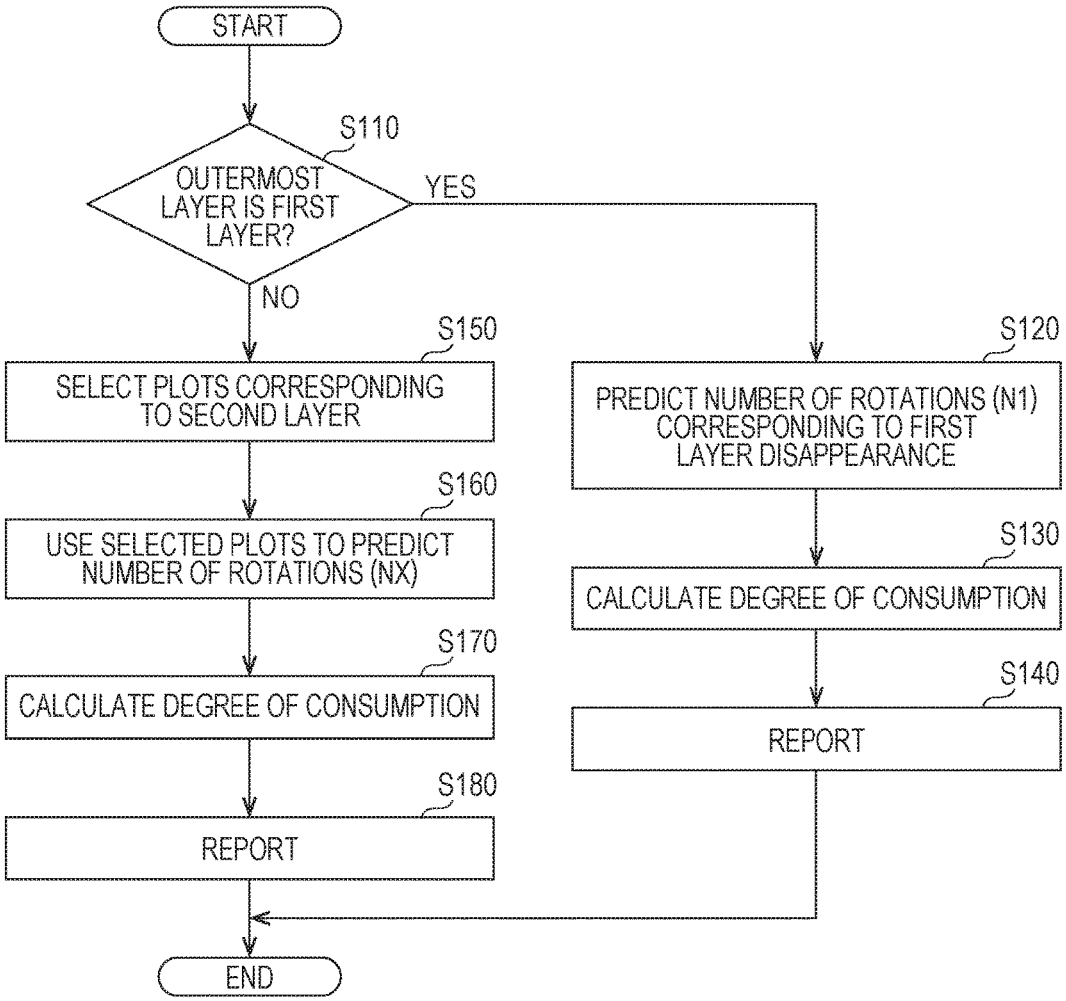
FIG. 5 is a flowchart of processing executed for predicting a degree of consumption of the photosensitive body in the image forming apparatus.

FIG. 5 is a flowchart of processing executed by the CPU 310 for predicting a degree of consumption of the photosensitive body 3 in the image forming apparatus 200. The CPU 310 can predict the degree of consumption for each of the photosensitive bodies 3Y, 3M, 3C, and 3K. The degree of consumption of each of the photosensitive bodies 3Y, 3M, 3C, and 3K can be predicted similarly. Therefore, in the following description, prediction of the degree of consumption of each of the photosensitive bodies 3Y, 3M, 3C, and 3K will be described as "prediction of the degree of consumption of the photosensitive body 3". The CPU 310 executes the program stored in the program storage 372, for example, thereby realizing the processing illustrated in FIG. 5.

As illustrated in FIG. 5, in step S110, the CPU 310 determines whether or not a layer currently lying on the outermost side in the photosensitive body 3 is the first layer 31 (FIG. 1). The CPU 310, when determining that the first layer 31 lies on the outermost side (YES in step S110), advances control to step S120, and when determining that the first layer 31 does not lie on the outermost side (NO in step S110), advances control to step S150. The CPU 310, for example, specifies the film thickness of the photosensitive body 3 on the basis of a current value measured by the ammeter 15. The data storage 374 (FIG. 4) may store data specifying film thicknesses corresponding to the first layer 31, the second layer 32, and the third layer 33. The CPU 310, for example, determines which layer lies on the outermost side in the photosensitive body 3 on the basis of the data and the film thickness specified.

In step S120, the CPU 310 specifies a prediction value (the number of rotations N1 of the graph 902 of FIG. 1) of the number of rotations of the photosensitive body 3 corresponding to the timing when the first layer 31 disappears (due to wear).

In step S130, the CPU 310 uses the number of rotations specified in step S120 to calculate the degree of consumption of the photosensitive body 3. The data storage 374 may store information specifying the number of rotations (the number of rotations NP of the graph 902 of FIG. 1) of the photosensitive body 3 predicted at which the second layer 32 is worn out to a state in which replacement of the photosensitive body 3 is required. The CPU 310, for example, adds up the number of rotations N1 and the number of rotations NP, to calculate the number of rotations (the number of rotations NX of the graph 902 of FIG. 1) from the start of use of the photosensitive body 3 to the state in which replacement is required, and calculates a ratio of the current number of rotations to the number of rotations NX as the degree of consumption of the photosensitive body 3. For example, when the number of rotations NX is "10,000", and the current number of rotations is "3,000", the degree of consumption is calculated as "30%".

In step S140, the CPU 310 reports the degree of consumption of the photosensitive body 3 calculated in step S130, and ends the processing of FIG. 5. An example of reporting is to display the degree calculated, in the operation panel 80.

Figure 6:
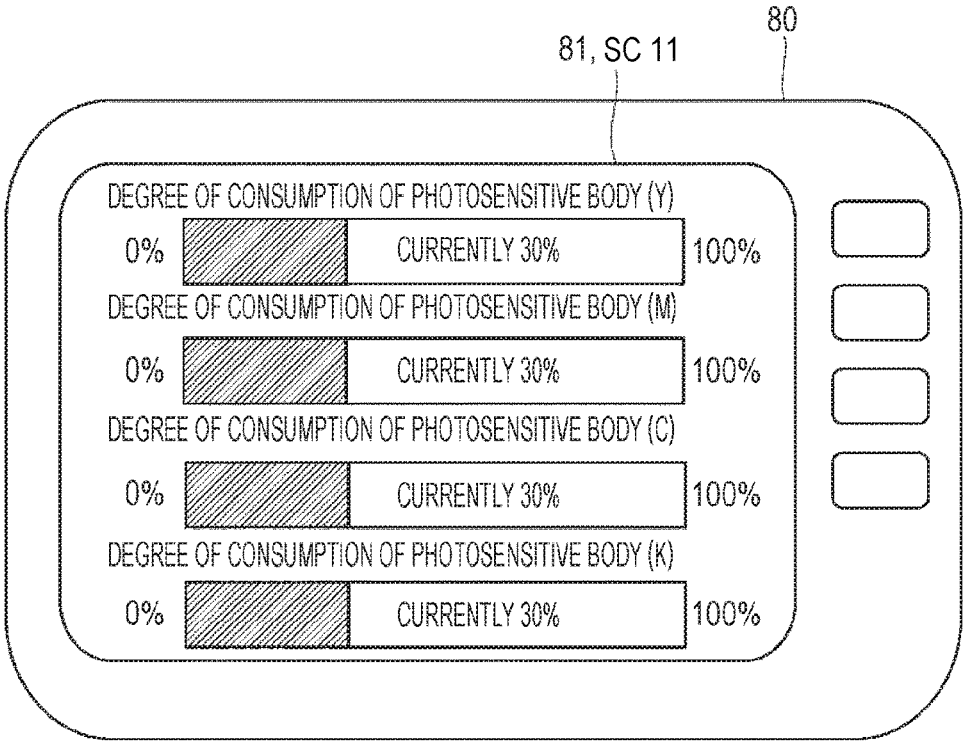
FIG. 6 is a diagram illustrating a display example of the degree of consumption of the photosensitive body.

FIG. 6 is a diagram illustrating a display example of the degree of consumption of the photosensitive body. As illustrated in FIG. 6, the operation panel 80 includes a touch screen 81. The touch screen 81 displays a screen SC 11. The screen SC 11 displays the degree of consumption of each of the photosensitive bodies 3Y, 3M, 3C, and 3K with a bar graph.

The CPU 310 may calculate and report a possible number of rotations before the replacement of the photosensitive body 3. The possible number of rotations before the replacement of the photosensitive body 3 is calculated by subtracting the current number of rotations from the number of rotations NX, for example.

Referring back to FIG. 5, in step S150, the CPU 310 selects plots corresponding to the second layer 32 from multiple plots representing a relationship between the film thickness and the number of rotations as indicated in the graph 902 and the graph 903 of FIG. 1. The CPU 310, for example, specifies the time when a measurement result of the film thickness reaches the thickness at which the second layer 32 is predicted to be exposed (the thickness at which the first layer 31 is predicted to be worn out and disappear), as timing when the second layer 32 begins to lie on the outermost side. Then, the CPU 310 selects plots after the timing as the plots corresponding to the second layer 32.

In step S160, the CPU 310 uses the plots selected in step S150, to predict the number of rotations (the number of rotations NX of the graph 903 of FIG. 1) corresponding to timing when the photosensitive body 3 is replaced. The CPU 310, for example, uses the plots selected in step S150 to generate a linear approximation (the line L12 of the graph 903 of FIG. 1), and specifies the number of rotations corresponding to the film thickness of the photosensitive body required to be replaced, in the linear approximation, as a prediction value of the number of rotations NX.

In step S170, the CPU 310 uses the number of rotations specified in step S160, to calculate the degree of consumption of the photosensitive body 3. The CPU 310, for example, calculates a ratio of the current number of rotations to the number of rotations NX, as the degree of consumption of the photosensitive body 3.

In step S180, the CPU 310 reports the degree of consumption of the photosensitive body 3 calculated in step S170, and ends the processing of FIG. 5. An example of reporting in step S180 may be a screen display as illustrated in FIG. 6.

In the processing of FIG. 5 described above, an aspect for predicting the degree of consumption of the photosensitive body 3 is changed depending on which layer lies on the outermost side in the photosensitive body 3. That is, in a case where the first layer 31 lies on the outermost side, the CPU 310 executes the control from step S150 to step S170.

In a case where the second layer 32 lies on the outermost side, the CPU 310 executes the control from step S120 to step S130.

In the example illustrated in FIG. 5, two layers of the first layer 31 and the second layer 32 have been exemplified as the layer that can lie on the outermost side; however, there may be three or more layers that can lie on the outermost side. That is, it can be assumed that three or more layers of the surface of the photosensitive body 3 are sequentially exposed in accordance with consumption of the photosensitive body 3 of the image forming apparatus 200.

Figure 7:
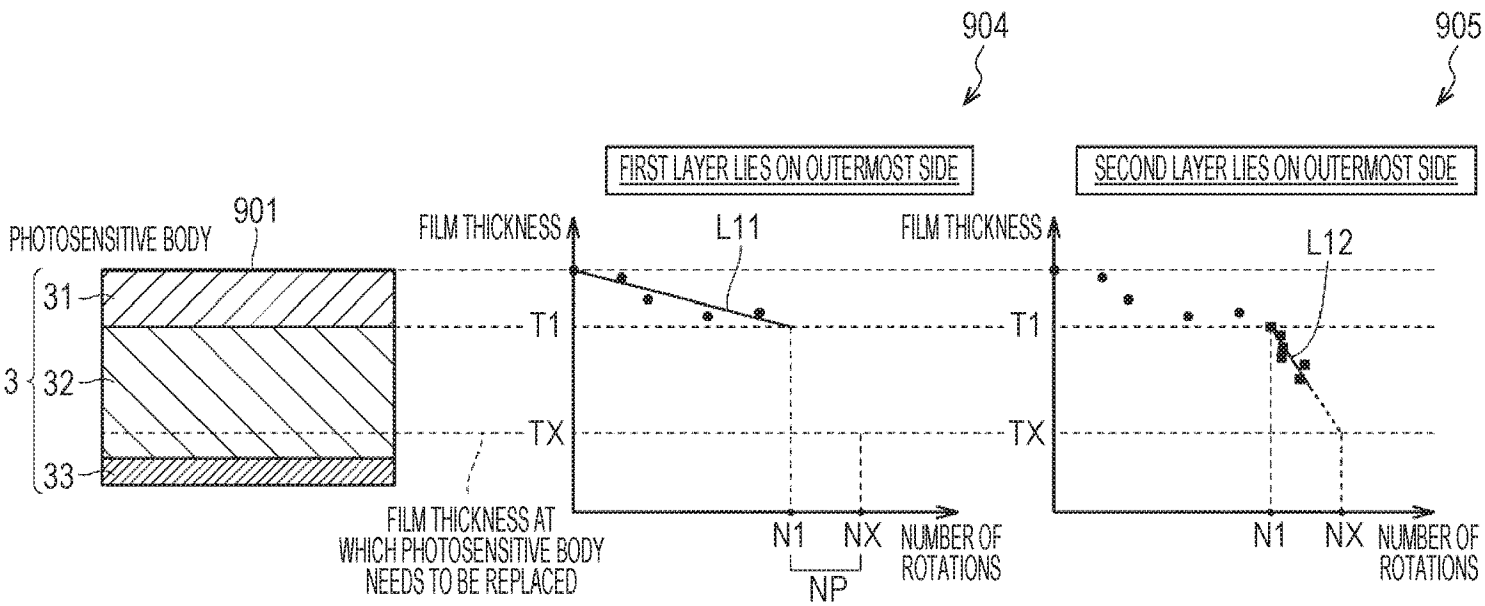
FIG. 7 is a diagram illustrating a method for calculating the degree of consumption of the photosensitive body.

With reference to FIGS. 7 and 8, an aspect will be described in detail of predicting the degree of consumption. FIG. 7 includes the line drawing 901, a graph 904, and a graph 905. The line drawing 901 of FIG. 7 schematically represents multiple layers of an outer part of the photosensitive body 3, similarly to FIG. 1. The graph 904 represents an approximate line (the line L11) generated when the first layer 31 lies on the outermost side. The graph 905 represents an approximate line (the line L12) generated when the second layer 32 lies on the outermost side. FIG. 8 shows a method for calculating the degree of consumption of the photosensitive body 3 in each of a situation 1 and a situation 2. The situation 1 is a situation in which the first layer 31 lies on the outermost side. The situation 2 is a situation in which the second layer 32 lies on the outermost side.

In the image forming apparatus 200, for example, in processing different from the processing of FIG. 5, such as active transfer voltage control (ATVC) operation, a value for specifying the film thickness of the photosensitive body 3 is measured as appropriate, and stored in the data storage 374 together with the corresponding number of rotations. The CPU 310 uses the data stored in the data storage 374, and can represent relationships as indicated in the graph 904 and the graph 905.

As indicated in the graph 904 in FIG. 7, when the ratio of consumption of the photosensitive body 3 is predicted in the period during which the first layer 31 lies on the outermost side, the CPU 310 uses the plots obtained up to that time to generate the line L11, predicts the number of rotations N1, and adds up the number of rotations N1 predicted and the number of rotations NP, to calculate the number of rotations NX. Then, the CPU 310, as shown as the situation 1 in FIG. 8, outputs a ratio of the current number of rotations NA to the number of rotations NX, as the degree of consumption of the photosensitive body 3.

As indicated in the graph 905 FIG. 7, when the ratio of consumption of the photosensitive body 3 is predicted in the period during which the second layer 32 lies on the outermost side, the CPU 310 uses the plots obtained after the surface of the photosensitive body 3 reaches the boundary between the first layer 31 and the second layer 32, to generate the line L12, and predicts the number of rotations NX. Then, the CPU 310, as shown as the situation 2 in FIG. 8, outputs the ratio of the current number of rotations NA to the number of rotations NX, as the degree of consumption of the photosensitive body 3.

[Using a Fixed Value as the Number of Rotations Up to Consumption of a Disappearing Layer]

Figure 9:
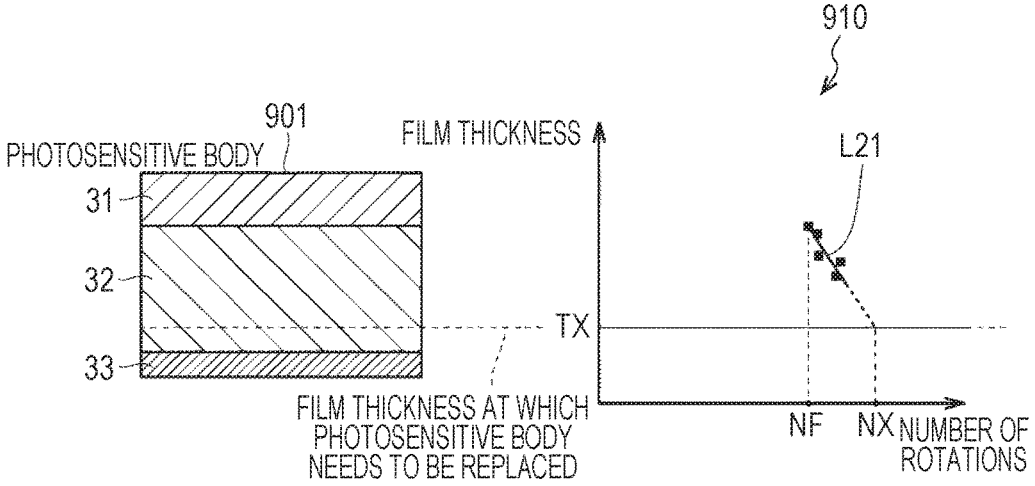
FIG. 9 is a diagram schematically illustrating a fixed value used as the number of rotations up to consumption of a first layer.

With reference to FIG. 9, processing details will be described of when a fixed value is used as the number of rotations when the first layer 31 is consumed. FIG. 9 is a diagram schematically illustrating a fixed value used as the number of rotations up to consumption of the first layer 31. FIG. 9 includes the line drawing 901 and a graph 910. In the graph 910, the number of rotations NF is a set value (fixed value) of the number of rotations of the photosensitive body 3 up to disappearance of the first layer 31. Information specifying the number of rotations NF is stored in the data storage 374, for example.

The CPU 310 determines whether or not the number of rotations has reached the number of rotations NF. The CPU 310, when the number of rotations has not yet reached the number of rotations NX, predicts the degree of consumption of the photosensitive body 3 in the aspect as explained with reference to step S120 and step S130 of FIG. 5.

The CPU 310, when determining that the number of rotations has reached the number of rotations NF, determines that the second layer 32 lies on the outermost side in the photosensitive body 3. The CPU 310, as illustrated in FIG. 9, uses the plots acquired when the number of rotations is after the number of rotations NF, to predict the number of rotations NX corresponding to the film thickness TX at which the photosensitive body 3 should be replaced. For the prediction, the CPU 310, for example, uses the plots acquired after the number of rotations NF, to generate an approximate line (the line L21 in FIG. 9), and specifies the number of rotations corresponding to the film thickness TX in the line L21, as the number of rotations NX.

Then, the CPU 310 calculates a prediction value of the degree of consumption of the photosensitive body 3, as the ratio of the current number of rotations to the number of rotations NX. In the example illustrated in FIG. 9, when the number of rotations exceeds the number of rotations NF, the degree of consumption of the photosensitive body 3 is predicted without using the plots of when the number of rotations is less than the number of rotations NF.

More specifically, for example, when the number of rotations NF is "5,000", the CPU 310 determines whether or not the current number of rotations has reached "5,000". The CPU 310, when the number of rotations has reached "5,000", uses a relationship between the film thickness and the number of rotations acquired in an area in which the number of rotations is "5,000" or more, to specify the number of rotations NX. For example, in a case where the number of rotations NX is specified as "10,000" and the current number of rotations is "7,000", the CPU 310 specifies the degree of consumption of the photosensitive body 3 as 70% ((7,000/10,000)×100%).

[A Case where Two or More Layers Disappear Before Lifetime of the Photosensitive Body Arrives]

In the example of FIG. 9, when the first layer 31 of the photosensitive body 3 disappears due to wear or the like, and then a part of the second layer 32 is worn out, and the film thickness of the photosensitive body 3 is the film thickness TX, it is determined that a lifetime of the photosensitive body 3 has arrived. That is, one layer disappears before the lifetime of the photosensitive body 3 arrives.

Figure 10:
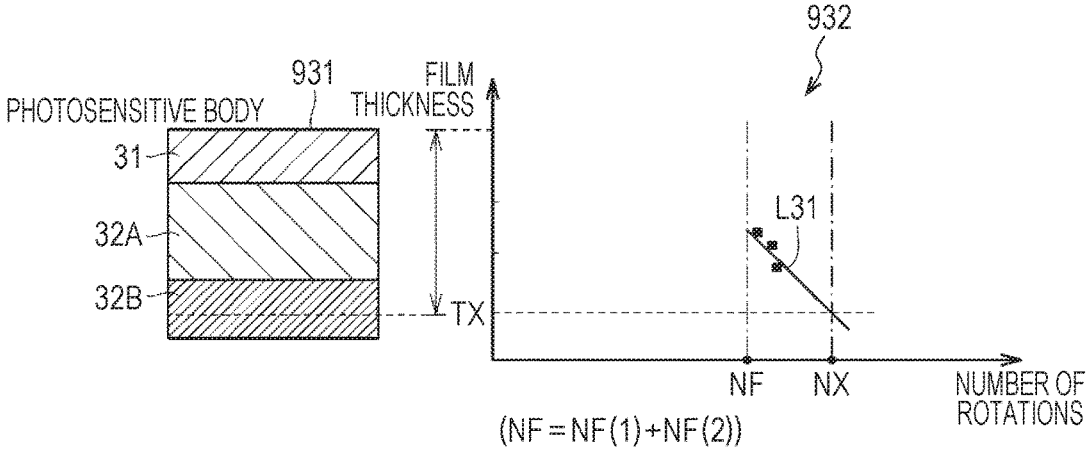
FIG. 10 is a diagram for explaining a predicting aspect of the degree of consumption in a case where two layers disappear before a lifetime of the photosensitive body arrives.

FIG. 10 is a diagram for explaining a predicting aspect of the degree of consumption in a case where two layers disappear before the lifetime of the photosensitive body 3 arrives. FIG. 10 illustrates a line drawing 931 representing multiple layers of the surface of the photosensitive body 3, and a graph 932 indicating a relationship between the film thickness and the number of rotations. As represented in the line drawing 931, in this example, from outer side of the photosensitive body 3, the first layer 31, a second layer 32A, and a third layer 32B are arranged. For example, the first layer 31 and the second layer 32A each are a so-called "coat layer". The third layer 32B is a so-called "charge transport layer".

In the example of FIG. 10, the film thickness TX represents the film thickness of the photosensitive body 3 of when it is determined that the lifetime has arrived. That is, when the film thickness of the photosensitive body 3 is the film thickness TX, it is determined that the lifetime of the photosensitive body 3 has arrived. Incidentally, when the film thickness is the film thickness TX, in the photosensitive body 3, the first layer 31 and the second layer 32A have disappeared, and the third layer 32B lies on the outermost side of the photosensitive body 3.

In the example of FIG. 10, when the third layer 32B lies on the outermost side in the photosensitive body 3, a set value (the number of rotations NF) is used of the number of rotations of the photosensitive body 3 up to disappearance of the first layer 31 and the second layer 32A. In this example, the number of rotations NF is a sum of a set value (NF(1)) of the number of rotations of the photosensitive body 3 up to disappearance of the first layer 31 and a set value (NF(2)) of the number of rotations of the photosensitive body 3 up to disappearance of the second layer 32A.

When the number of rotations of the photosensitive body 3 reaches the number of rotations NF, on the basis of a relationship between the film thickness and the number of rotations in an actual measurement value acquired after that, the CPU 310 predicts the number of rotations NX. In the prediction, the CPU 310 uses a linear approximate line based on the actual measurement value, as indicated as a line L31, for example.

For example, in a case where it is set that the first layer 31 disappears when the photosensitive body 3 has rotated 2,500 times, and further the second layer 32A disappears when the photosensitive body 3 has rotated 3,000 times, the number of rotations NF(1) and the number of rotations NF(2) are "2,500" and "3,000", respectively. The CPU 310, as the number of rotations NF, sets a sum of the number of rotations NF(1) and the number of rotations NF(2), that is, "5,500".

The CPU 310 determines whether or not the current number of rotations has reached "5,500". The CPU 310, when the number of rotations has reached "5,500", uses a relationship between the film thickness and the number of rotations acquired in an area in which the number of rotations is "5,500" or more, to specify the number of rotations NX. For example, in a case where the number of rotations NX is specified as "10,000" and the current number of rotations is "8,000", the CPU 310 specifies the degree of consumption of the photosensitive body 3 as 80% ((8,000/10,000)×100%).

[Abstract of Disclosure]

(1) In the present disclosure, the image forming apparatus 200 includes the image forming device (an element including the imaging units 2Y, 2M, 2C, and 2K) that forms an image by an electrophotographic method. The image forming device includes the photosensitive body 3 on which two or more layers (the first layer 31, the second layer 32, and the like) are laminated. The image forming apparatus 200 further includes a controller (the CPU 310) that predicts the degree of consumption of the photosensitive body 3. The controller may specify the timing when a layer begins to lie on the outermost side, the layer being one of the two or more layers and lying on the outermost side at the time of predicting the degree of consumption (for example, the number of rotations N1 corresponding to the film thickness T1 in the graph 905 of FIG. 7), and may use an electrical characteristic of the image forming device after the timing specified (plots after the number of rotations N1), to predict the degree of consumption of the photosensitive body.

In the present disclosure, as the timing, a temporal location may be specified, or as indicated as a value of the number of rotations of the photosensitive body in FIG. 7, an operating state of the image forming apparatus 200 may be specified.

(2) The image forming device may further include a charging member (the charging rollers 4Y, 4M, 4C, and 4K) that applies voltage to the photosensitive body. The above-described electrical characteristic may include a current value of when a predetermined voltage is applied to the charging member, and the controller may predict the degree of consumption of the photosensitive body on the basis of a gradient of a linear function of (the film thickness specified by) the current value and the number of rotations of the photosensitive body.

(3) The controller may predict the degree of consumption of the photosensitive body without using the electrical characteristic before the timing specified.

(4) The controller may specify the timing by using a fixed value (the number of rotations NF of FIG. 9) set for a layer that has lain outside a layer lying on the outermost side at the time of predicting the degree of consumption.

(5) The controller may specify the timing by using fixed values (the number of rotations NF(1) and the number of rotations NF(2) of FIG. 10) respectively set for two or more layers that have lain outside a layer lying on the outermost side at the time of predicting the degree of consumption.

(6) The two or more layers may include a first layer (the first layer 31 of FIG. 1 and other figures), and a second layer (the second layer 32 of FIG. 1 and other figures) laminated on the inside from the first layer. The controller may use the electrical characteristic at time of a first number (a measurement value of the electrical characteristic of the first number) acquired in a period during which the first layer lies on the outermost side, to specify the timing when the second layer begins to lie on the outermost side (to obtain the number of rotations N1 corresponding to the film thickness T1). The controller may use the electrical characteristic at time of a second number greater than the first number (a measurement value of the electrical characteristic of the second number) acquired in a period during which the second layer lies on the outermost side, to predict timing corresponding to lifetime expiration of the photosensitive body. The fact that the second number of points are more than the first number of points, corresponds to, for example, the fact that the number of plots for obtaining the line L11 is greater than the number of plots for obtaining the line L12.

(7) The controller may specify timing when a layer lying on the outermost side is switched in the photosensitive body in a case where a predetermined condition is satisfied.

(8) The condition may be related to the length of time during which the photosensitive body has been used for image formation. That is, in the example described with reference to FIG. 9, in accordance with the fact that the number of rotations of the photosensitive body 3 has reached the number of rotations NF, it is determined that the layer lying on the outermost side in the photosensitive body 3 is switched from the first layer 31 to the second layer 32. As a modification of the example, the CPU 310, on the condition that the length of the time during which the photosensitive body 3 has been used for the image formation, that is, the time during which the photosensitive body 3 has been charged by the charging roller 4 has reached a predetermined time, may determine that the layer lying on the outermost side in the photosensitive body 3 is switched from the first layer 31 to the second layer 32.

(9) The image forming device may further include the charging member (charging roller 4) that applies voltage to the photosensitive body. The condition may include an item related to the film thickness of the photosensitive body calculated on the basis of a current value of when the charging member applies a predetermined voltage. That is, the CPU 310, on the condition that the film thickness specified in accordance with a measurement value of the ammeter 15 is decreased to the film thickness T1, may determine that the layer lying on the outermost side in the photosensitive body 3 is switched from the first layer 31 to the second layer 32.

(10) The image forming device may further include the charging member (charging roller 4) that applies voltage to the photosensitive body. The condition may include an item related to a relationship (the line L11 of FIG. 1 and other figures) between the number of rotations and the film thickness estimated on the basis of the number of rotations of the photosensitive body and the film thickness of the photosensitive body calculated on the basis of the current value of when the charging member applies a predetermined voltage.

Although embodiments of the present invention have been described and illustrated in detail, the disclosed embodiments are made for purposes of illustration and example only and not limitation. The scope of the present invention should be interpreted by terms of the appended claims. The scope of the present invention is intended that meanings equivalent to the claims and all modifications within the scope are included. In addition, the invention described in the embodiment and each modification is intended to be implemented alone or in combination, as far as possible.

What is claimed is:

1. An image forming apparatus comprising:

an image forming device that forms an image by an electrophotographic method, the image forming device including:

a photosensitive body on which two or more layers are laminated; and a hardware processor that predicts a degree of consumption of the photosensitive body, wherein the hardware processor:

specifies a timing at which a layer begins to lie on an outermost side, the layer being one of the two or more layers and lying on the outermost side at a time of predicting the degree of consumption, and uses an electrical characteristic of the image forming device after the timing specified, to predict the degree of consumption of the photosensitive body.

2. The image forming apparatus according to claim 1, wherein:

the image forming device further includes a charging member that applies voltage to the photosensitive body, the electrical characteristic includes a current value of a predetermined voltage applied to the charging member, and the hardware processor predicts the degree of consumption of the photosensitive body based on a gradient of a linear function of the current value and a number of rotations of the photosensitive body.

3. The image forming apparatus according to claim 1, wherein the hardware processor predicts the degree of consumption of the photosensitive body without using the electrical characteristic before the timing specified.

4. The image forming apparatus according to claim 3, wherein the hardware processor specifies the timing by using a fixed value set for a layer that has lain outside the layer lying on the outermost side at the time of predicting the degree of consumption.

5. The image forming apparatus according to claim 4, wherein the hardware processor specifies the timing by using fixed values respectively set for two or more layers that have lain outside the layer lying on the outermost side at the time of predicting the degree of consumption.

6. The image forming apparatus according to claim 1, wherein the two or more layers include a first layer and a second layer laminated on an inner side of the first layer, and wherein the hardware processor:

uses the electrical characteristic at a time of a first number acquired in a period during which the first layer lies on the outermost side, to specify a timing at which the second layer begins to lie on the outermost side, and uses the electrical characteristic at a time of a second number greater than the first number acquired in a period during which the second layer lies on the outermost side, to predict a timing corresponding to a lifetime expiration of the photosensitive body.

7. The image forming apparatus according to claim 1, wherein the hardware processor specifies a timing at which a layer lying on the outermost side is switched in the photosensitive body in a case where a predetermined condition is satisfied.

8. The image forming apparatus according to claim 7, wherein the predetermined condition is related to a length of time during which the photosensitive body has been used for image formation.

9. The image forming apparatus according to claim 7, wherein the image forming device further includes a charging member that applies voltage to the photosensitive body, and wherein the predetermined condition includes an item related to a film thickness of the photosensitive body calculated based on a current value when the charging member applies a predetermined voltage.

10. The image forming apparatus according to claim 7, wherein the image forming device further includes a charging member that applies voltage to the photosensitive body, and wherein the predetermined condition includes an item related to a relationship between a number of rotations and a film thickness estimated based on the number of rotations of the photosensitive body and the film thickness of the photosensitive body calculated based on a current value when the charging member applies a predetermined voltage.

* * * * *